US005277041A

United States Patent [19]

Ahrweiler et al.

[11] Patent Number: 5,277,041

[45] Date of Patent: Jan. 11, 1994

[54] DRAIN BOARD FOR A DEVICE FOR APPLYING A LIQUID FILM TO A WEB OF TEXTILE MATERIAL

[75] Inventors: Karl-Heinz Ahrweiler, Willich; Alfred Blasius, Tönisvorst; Wolfgang Kurschatke, Krefeld, all of Fed. Rep. of Germany

[73] Assignee: Eduard Küsters Maschinenfabrik GmbH & Co. KG, Krefeld, Fed. Rep. of Germany

[21] Appl. No.: 916,833

[22] PCT Filed: May 11, 1991

[86] PCT No.: PCT/DE91/00387

§ 371 Date: Aug. 12, 1992

§ 102(e) Date: Aug. 12, 1992

[87] PCT Pub. No.: WO91/18140

PCT Pub. Date: Nov. 28, 1991

[30] Foreign Application Priority Data

May 18, 1990 [DE] Fed. Rep. of Germany ..... 4015946

[51] Int. Cl.[5] ..... D06B 1/04

[52] U.S. Cl. ..... 68/205 R; 68/200; 68/900; 118/325

[58] Field of Search ..... 68/200, 205; 118/324, 118/325; 101/425

[56] References Cited

U.S. PATENT DOCUMENTS

| | | | |
|---|---|---|---|
| 4,183,234 | 1/1980 | Grüber et al. | 68/205 |
| 4,369,640 | 1/1983 | Fox | 68/205 R |
| 4,377,080 | 3/1983 | Fox | 68/205 R |
| 4,463,583 | 8/1984 | Kruger et al. | 68/205 R |
| 4,547,921 | 10/1985 | Otting et al. | 68/205 R |
| 5,048,314 | 9/1991 | Keller et al. | 68/205 R |
| 5,063,758 | 11/1991 | Keller et al. | 68/205 R |

FOREIGN PATENT DOCUMENTS

| | | | |
|---|---|---|---|
| 0019035 | 11/1980 | European Pat. Off. . | |
| 1269547 | 5/1968 | Fed. Rep. of Germany . | |
| 2132885 | 6/1973 | Fed. Rep. of Germany . | |
| 7403152 | 5/1974 | Fed. Rep. of Germany . | |
| 2548890 | 12/1977 | Fed. Rep. of Germany . | |
| 2812219 | 7/1987 | Fed. Rep. of Germany . | |
| 0497926 | 12/1970 | Switzerland . | |
| 1296725 | 11/1972 | United Kingdom | 68/205 R |
| 1363129 | 11/1974 | United Kingdom | 68/205 R |

*Primary Examiner*—Frankie L. Stinson
*Attorney, Agent, or Firm*—Kenyon & Kenyon

[57] ABSTRACT

Described is a drain board (100) for a device for applying a liquid film to a web (8) of textile material. The drain board (100) comprises a support (1), on which a strip (10), which constitutes the draining surface (A) and is made of planar material is held flat, for example by magnets (3), by means of a vacuum or by a contact adhesive. The liquid is poured out at point (4) on to the draining surface (A); it flows down and falls off the lower edge (6) of the strip (10) in a falling film (7) or veil on to the fabric web (8). As a result of the magnetic retention, the strip cannot be replaced (FIG. 1).

18 Claims, 1 Drawing Sheet

DRAIN BOARD FOR A DEVICE FOR APPLYING A LIQUID FILM TO A WEB OF TEXTILE MATERIAL

BACKGROUND OF THE INVENTION

The invention relates generally to drain boards and more particularly to a drain board for applying a liquid film to a web of textile material.

These types of devices are used, for example, in the dyeing of webs of carpet. The liquid dye is applied to the drain board, whether it be by applying it with a doctor blade or by pouring it over the plate, and it runs over the drain board, which is tilted down at an angle over the web of textile material, in a uniform layer, to then fall from the lower edge of the drain board in a uniform film or veil on to the web, whose height of fall amounts to about 0–10 cm. That is the lower edge of the drain board takes up a position over the web that lies somewhere between nearly touching and being slightly above the web. The height must not be so great that the veil again loses uniformity in the fall and comes together to form individual concentrated threads of stream or strands.

When coating devices of this type are used, the quantities of liquid dye required for dyeing carpet are able to be quantitatively regulated with a high degree of accuracy and when they are applied to the fabric web running past under the drain board. However, to ensure a level application, the lower edge of the drain board must be especially uniform and the drain board must be particularly even. Even irregularities, such as a ground down rivet head or a welding spot, can already cause disturbances in the uniform run-off of the liquid, giving rise to inhomogeneities in the falling liquid veil and thus to visible streakiness in the final look of the dyed fabric.

In practice, it is not easy to optimally do justice to the important requirements. Carpet webs have a width of up to five meters and, therefore, the support for the run-off surface must cover the carpet web over this width without sagging, without vibrating during operation, and without showing any waviness or other disturbance, in particular in the lower edge of the run-off surface.

Up until now, one mostly manufactured the run-off surfaces out of sheet metal, connected them to the support, and then assembled them together with this support. Often enough, when the sensitive run-off surface experienced impacts when it was mounted on the support, which had to be quite heavy for reasons of stability, these impacts led to deformations, dents, etc. The runoff surface then had to be disassembled, which involved costly work, and be replaced by a new one, whereby in many cases even the support had to be completely removed. Also, a careful enough handling of the run-off surface during operation could not always be guaranteed, so that cumbersome replacements likewise had to be made. The same was true, for example, when the transition had to be made from a drain board with a straight edge to a drain board with a toothed or jagged edge, when the application called for a liquid dye with different physical properties.

The device underlying the introductory part of claim 1 can be inferred from the German Patent 28 12 219. In the case of the known device, the drain board consists of a baffle plate tilted downwards, whose lower edge section adjacent to the web is formed by a relatively thin, stretched foil, whose lower edge constitutes the run-off rim for the thin liquid film. The baffle plate, together with its thin foil, forms a plane, which is inclined in the requisite manner with respect to the horizontal plane.

From the German Patent 28 12 219, one cannot infer in detail how the foil is supposed to be tensioned. In any case, however, the flatness of the foil is supposed to be produced by the tensioning action, so that the foil must exhibit appropriate deformability, which makes the configuration highly sensitive in a mechanical respect.

The object of the invention is to create an operationally reliable device of this type, in which the run-off surface can be easily replaced.

SUMMARY OF THE INVENTION

The strip that constitutes the run-off edge, therefore, should not get its evenness first from the forces exerted by the support, but rather demonstrate such a flexural strength that it retains of its own accord the planarity bestowed upon it in manufacturing, even when subjected to the stress of being secured to the support. There should be no point-by-point introduction of forces through screws, rivets or welding points. Rather, the retention forces acting perpendicularly to the strip should be effective in surface areas which take up a larger part or, however, the entirety of the overlap surface of the strip and the supporting area. An important aspect is that the connection is able to be detached without necessitating a costly assembly and, most of all, without destroying the strip, only while overcoming forces which do in fact retain the strip in its position reliably enough during operation, but are not so great that the strip is damaged when overcoming these forces, that is to say other than being elastically deformed.

One had already recognized earlier on the difficulties entailed in manufacturing run-off surfaces in devices of the type mentioned at the outset. Thus, the German Published Patent Application 25 48 890 and the German GM 74 03 152 aspired to a perfect run-off surface by specifying a configuration in which an elastic foil is tightly stretched on a vertical wall at right angles across the fabric web, and the end projecting at the top from the tightened foil is bent down in an arc by more than 90°. The bent-over side constitutes the run-off surface with the run-off edge. This side is retained in its position by a baffle plate resting on top of it, on which the liquid runs down from the top and then passes over on to the foil side. Such a configuration makes it very difficult to achieve a truly uniform run-off rim across larger web widths. Besides, even the step at the junction from the baffle plate to the foil can already cause undesirable irregularities in the liquid film that is running off.

The German Published Patent Application 12 69 547 discloses a device for the casting application of plastic dispersions or the like. Its FIG. 5 depicts an inclined gliding surface, at whose upper end a lamellar removal blade of thin spring steel is attached, while details of this fastening are not visible. However, this is not a question of a generic device, in which the strip, projecting out freely, forms the run-off rim, but rather of a doctor blade, which fits on a roller and removes the plastic dispersion from this roller. One is not confronted with the problems of stability and evenness in this case, because the edge of the blade is stabilized by the roller, which it abuts on, from the outside.

In a first specific embodiment of the invention, the strip is held magnetically on the supporting surface.

The magnets have a certain extent parallel to the supporting surface and thus, in their area, exert a planar attractive force on the ferromagnetic strip.

An alternative specific embodiment provides for retaining the strip through a vacuum action on the supporting surface.

Another specific embodiment foresees retaining the strip on the supporting surface by means of a contact adhesive.

It is recommended to use an adhesive foil that sticks on both sides, so that one does not have the cumbersome task of first applying the contact adhesive.

The strip can expediently consist of a hard-rolled spring-steel sheet metal of 0.3 to 1 mm thickness.

This material has the advantage of very good surface evenness and, moreover, in case of shock or impact, it is not easily plastically deformed due to its very high yield strength. The stresses are therefore withstood without any permanent change to the planar draining surface.

When no ferromagnetic properties are required, the strip can also consist of a plastic material, in particular of a laminated material, as is known for example in the form of melamine-resin-impregnated hard laminated material, as used in the facing of kitchen cabinets or the like. This material exhibits and retains a very good surface evenness.

DETAILED DESCRIPTION

Figure 1:
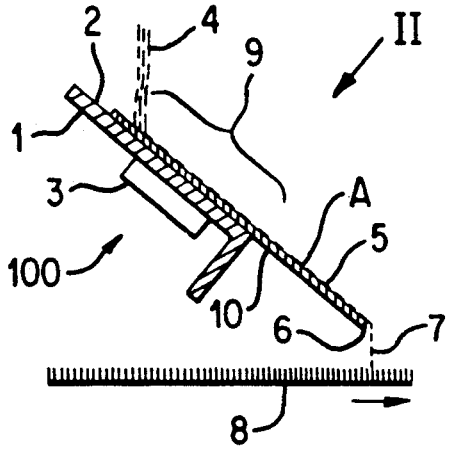
FIG. 1 depicts a cross-section through a drain board according to the invention in a vertical plane running in the longitudinal direction of the web.

The drain board designated as a whole by 100 in FIG. 1 comprises a support 1 in the form of an angle section of steel, which extends horizontally across the fabric web 8 and, on the top side, offers a flat supporting surface 2, which in the exemplified embodiment is tilted down toward the web by about 40° in a plane that runs vertically in the longitudinal direction of the web. A strip 10 of flat spring-steel sheet metal of 0.5 mm thickness rests on the supporting surface 2 in a bearing-surface area 9, which corresponds more or less to half the width of the strip 10. Thus, the strip 10 extends with its longitudinal direction at an oblique angle relative to the web. The bottom half of the strip projects down freely and forms a draining surface A with a horizontal, straight edge 6, arranged closely above the fabric web 8.

In the upper area of the draining surface A, a liquid is poured out at point 4 on to the draining surface A. It flows down in a uniform layer 5 in accordance with the slant of the draining surface A and falls off the lower edge 6 of the draining surface A as a free-falling film or curtain 7 on to the fabric web 8, which is moved along in the direction of the arrow under the edge 6.

The strip 10 lies flat on the bearing surface 2 and is held fast on the bearing surface 2 by a number of permanent magnets 3, which are distributed along the support 1 and arranged on its back side. Apart from that, the strip 10 is not connected to the supporting surface 2. In operation, however, the force of the magnets 3 does not suffice to retain the strip 10 in its position with sufficient force. To replace the strip 10, it is simply removed from the supporting surface 2 by exerting a comparably greater force.

Figure 2:
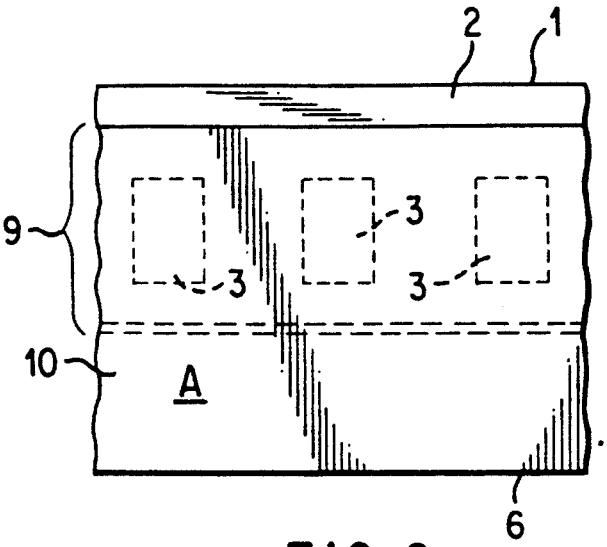
FIG. 2 shows a view in the direction II in FIG. 2.

The permanent magnets 3 exert their force on a surface which makes up about 20% of the bearing-surface area 9 in the exemplified embodiment depicted in FIG. 2. To ensure an adequate planarity of the application of force, its surface share should not fall below 10% here, as well as in the other exemplified embodiments.

To the extent that the parts present in the other exemplified embodiments correspond functionally, the same reference numbers are used.

Figure 3:
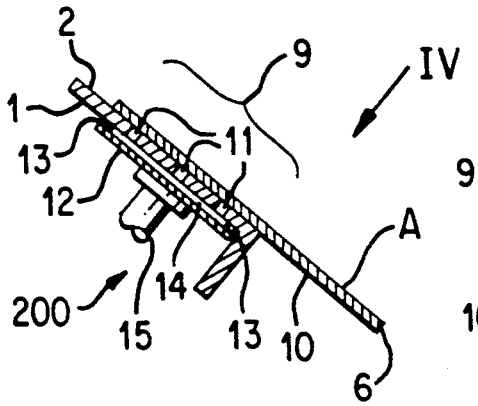
FIG. 3 and 4 or 5 and 6 depict corresponding views of other specific embodiments.
Figure 4:
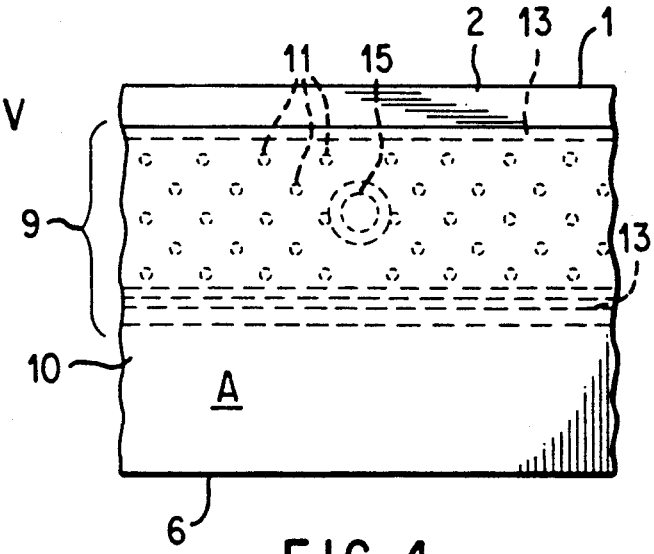

In the case of the draining edge 200 of FIG. 3, bore holes 11 are uniformly distributed over the surface in the bearing-surface area 9 in the side of the support 1 forming the supporting surface 2. They lead on the rear side into a chamber 14, which is formed by a plate 12 that is parallel to the side of the support 1 and is sealed off all around at the edges by seals 13, which keep the plate 12 at a distance from the rear side of the support side. The chamber 14 can be connected to a vacuum pump through a port 15 and evacuated. The negative pressure holds the strip 10 fast so that it rests on the supporting surface 2. The zone in which bore holes 11 are present does not need to extend over the entire bearing surface 9 as it does in the exemplified embodiment of FIG. 4.

Figure 5:
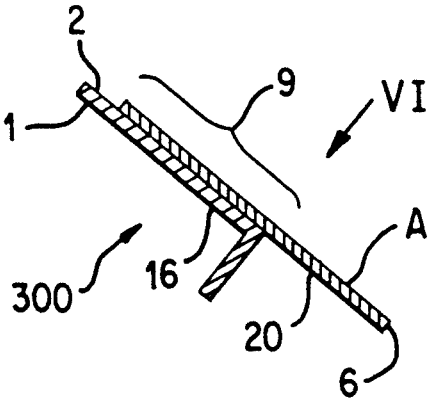
Figure 6:
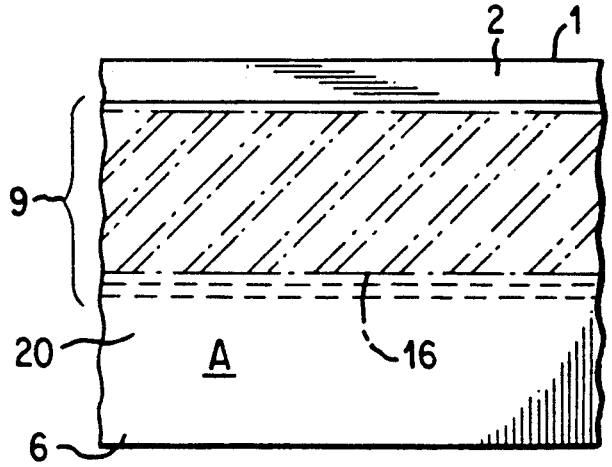

In the case of the drain board 300 of FIG. 5, the strip 20 does not consist, as in the preceding examples, of spring-steel sheet metal, but rather of a thin, that is 1 to 2 mm thick plastic laminate, for example of melamine-resin-impregnated paper layers. This strip 20 is connected to the supporting surface 2 through a strip of a double-sided adhesive foil 16 that extends over the bearing surface 9. The adhesive foil 16 is adjusted so that the strip 20 can be removed from the supporting surface 2 with the proper force expenditure of force, without damaging the strip 20. Instead of the wide adhesive-foil strip 16, several narrower adhesive-foil strips or several adhesive-foil patches can be used.

What is claimed is:

1. A drain board for a device applying a liquid film to a web of textile material, said drain board extending obliquely over the web and tilting down toward the web of textile material in a vertical longitudinal plane, said drain board comprising:

a support having a flat supporting surface and a lower edge extending horizontally above the web; and an intrinsically stable, flat, detachable strip connected to said support and forming a draining surface with the lower edge of the support, said strip having a bearing surface area disposed on said supporting surface of the support, said bearing-surface area being coupled to said supporting surface by forces acting in a direction substantially perpendicular to the plane of said strip such that said supporting surface is free of bore holes, whereby the liquid can be applied to an upper area of the drain board so that the liquid runs down over the draining surface and falls onto the web from the lower edge thereof as a substantially uniform film.

2. The drain board of claim 1 further comprising means for magnetically supporting said strip on said supporting suriace of said support.

3. The drain board of claim 2 wherein said magnetic supporting means comprises at least one permanent magnet disposed under said supporting surface of said support.

4. The drain board according to claim 3 wherein said strip is formed from hard-rolled spring-steel sheet metal having a thickness of approximately 0.3 to 1 mm.

5. The drain board of claim 2 wherein said magnetic supporting means comprises at least one permanent magnet disposed in said supporting surface of said support.

6. The drain board of claim 1 further comprising means for supporting said strip on said supporting surface of said support with forces arising from a pressure differential.

7. The drain board according to claim 6 wherein said supporting means includes a plurality of bore holes disposed in said supporting surface which are distributed in a region of said supporting surface adjacent to the bearing surface of the strip, said supporting means also including a chamber that is under a vacuum and which is coupled to said bore holes so that said chamber can be sealed by the strip.

8. The drain board according to claim 7 wherein said strip is formed from hard-rolled spring-steel sheet metal having a thickness of approximately 0.3 to 1 mm.

9. The drain board according claim 7 wherein said strip is formed from a flat plastic material.

10. The drain board according claim 6 wherein said strip is formed from a flat plastic material.

11. The drain board of claim 1 further comprising contact adhesive for retaining said strip on said supporting surface.

12. The drain board of claim 11 wherein said contact adhesive comprises a double-sided adhesive foil that is applied between the strip and the supporting surface.

13. The drain board according to claim 12 wherein said strip is formed from hard-rolled spring-steel sheet metal having a thickness of approximately 0.3 to 1 mm.

14. The drain board according claim 12 wherein said strip is formed from a flat plastic material.

15. The drain board according claim 11 wherein said strip is formed from a flat plastic material.

16. The drain board according to claim 1 wherein said strip is formed from hard-rolled spring-steel sheet metal having a thickness of approximately 0.3 to 1 mm.

17. The drain board according claim 1 wherein said strip is formed from a flat plastic material.

18. The drain board of claim 17 wherein said strip comprises a laminated material formed from synthetic resin-impregnated paper layers.

* * * * *